US010934757B2

(12) United States Patent
Svara et al.

(10) Patent No.: US 10,934,757 B2
(45) Date of Patent: Mar. 2, 2021

(54) DAMPER ASSEMBLIES

(71) Applicant: Titus d.o.o. Dekani, Dekani (SI)

(72) Inventors: Valter Svara, Izola (SI); David Pecar, Pobegi (SI); Emanuel Penko, Koper (SI); Miha Srebot, Divaca (SI)

(73) Assignee: Titus d.o.o. Dekani, Dekani (SI)

( * ) Notice: Subject to any disclaimer, the term of this patent is extended or adjusted under 35 U.S.C. 154(b) by 0 days.

(21) Appl. No.: 16/478,152

(22) PCT Filed: Dec. 20, 2017

(86) PCT No.: PCT/EP2017/083814
§ 371 (c)(1),
(2) Date: Jul. 16, 2019

(87) PCT Pub. No.: WO2018/134020
PCT Pub. Date: Jul. 26, 2018

(65) Prior Publication Data

US 2019/0368257 A1 Dec. 5, 2019

(30) Foreign Application Priority Data

Jan. 19, 2017 (GB) ..... 1700915

(51) Int. Cl.
*E05F 5/00* (2017.01)
*E05F 5/02* (2006.01)

(52) U.S. Cl.
CPC ..... *E05F 5/006* (2013.01); *E05F 5/02* (2013.01); *E05Y 2201/238* (2013.01); *E05Y 2201/256* (2013.01); *E05Y 2201/638* (2013.01); *E05Y 2900/20* (2013.01)

(58) Field of Classification Search
CPC ..... E05F 5/006; E05F 5/02
See application file for complete search history.

(56) References Cited

U.S. PATENT DOCUMENTS

| | | | | |
|---|---|---|---|---|
| 8,186,014 | B2 | 5/2012 | Pecar et al. | |
| 8,640,305 | B2 * | 2/2014 | Pecar | E05F 5/006 16/50 |
| 8,689,402 | B2 * | 4/2014 | Brunnmayr | E05F 5/006 16/286 |

(Continued)

FOREIGN PATENT DOCUMENTS

| | | | |
|---|---|---|---|
| GB | 2469847 | A | 11/2010 |
| JP | 2015534019 | A | 11/2015 |

*Primary Examiner* — Jason W San
(74) *Attorney, Agent, or Firm* — Alan D. Kamrath; Karin L. Williams; Mayer & Williams PC

(57) ABSTRACT

A damper assembly is provided for a toggle type hinge with a mounting flange (13) and an arm assembly (11) pivotally connected thereto. The assembly comprises a damping device (16) that is actuable along a linear axis and a housing (20) mounted on the mounting flange to retain the damping device. The assembly further comprises means for converting pivotal movement of the hinge into linear actuation of the damping device. This comprises an actuating lever (21) connected to the damping device and engageable with the hinge arm assembly via a first camming mechanism causing the actuating lever to rotate in response to pivotal movement of the hinge arm assembly. A second camming mechanism causes linear displacement of the actuating lever in response to its rotational movement.

9 Claims, 2 Drawing Sheets

(56) References Cited

U.S. PATENT DOCUMENTS

| | | | | |
|---|---|---|---|---|
| 8,925,151 | B2 * | 1/2015 | Salice | E05F 5/02 16/286 |
| 9,879,462 | B2 | 1/2018 | Svara et al. | |
| 10,718,146 | B2 * | 7/2020 | Svara | F16F 9/19 |
| 2009/0119876 | A1 * | 5/2009 | Pecar | E05F 5/02 16/293 |
| 2010/0139041 | A1 * | 6/2010 | Pecar | E05F 5/006 16/273 |
| 2012/0036678 | A1 * | 2/2012 | Pecar | E05F 5/006 16/250 |
| 2016/0010380 | A1 * | 1/2016 | Svara | E05F 5/10 49/386 |
| 2016/0273258 | A1 * | 9/2016 | Pecar | E05F 5/02 |
| 2017/0022744 | A1 * | 1/2017 | Migli | E05F 5/006 |
| 2017/0175430 | A1 * | 6/2017 | Svara | E05F 5/006 |
| 2019/0368257 | A1 * | 12/2019 | Svara | E05F 5/02 |

* cited by examiner

DAMPER ASSEMBLIES

This invention relates to damper assemblies, and more particularly, to damper assemblies for use with toggle type hinges of the sort that are typically used to hang kitchen cupboards.

This invention provides a damper assembly for a toggle type hinge with a mounting flange and an arm assembly pivotally connected thereto, the damper assembly comprising a damping device actuable along a linear axis, a housing mounted in use directly or indirectly on the mounting flange and retaining the damping device thereon with its linear axis parallel to the pivotal axis of the hinge, and means for converting pivotal movement of the hinge into linear actuation of the damping device over at least part of the range of pivotal movement of the hinge in one direction, with the movement converting means comprising an actuating lever connected to the damping device and engageable with the hinge arm assembly via a first camming mechanism causing the actuating lever to rotate in response to pivotal movement of the hinge arm assembly, and a second camming mechanism causing linear displacement of the actuating lever in response to its rotational movement, with the second camming mechanism being arranged to act against the housing.

Figure 1:
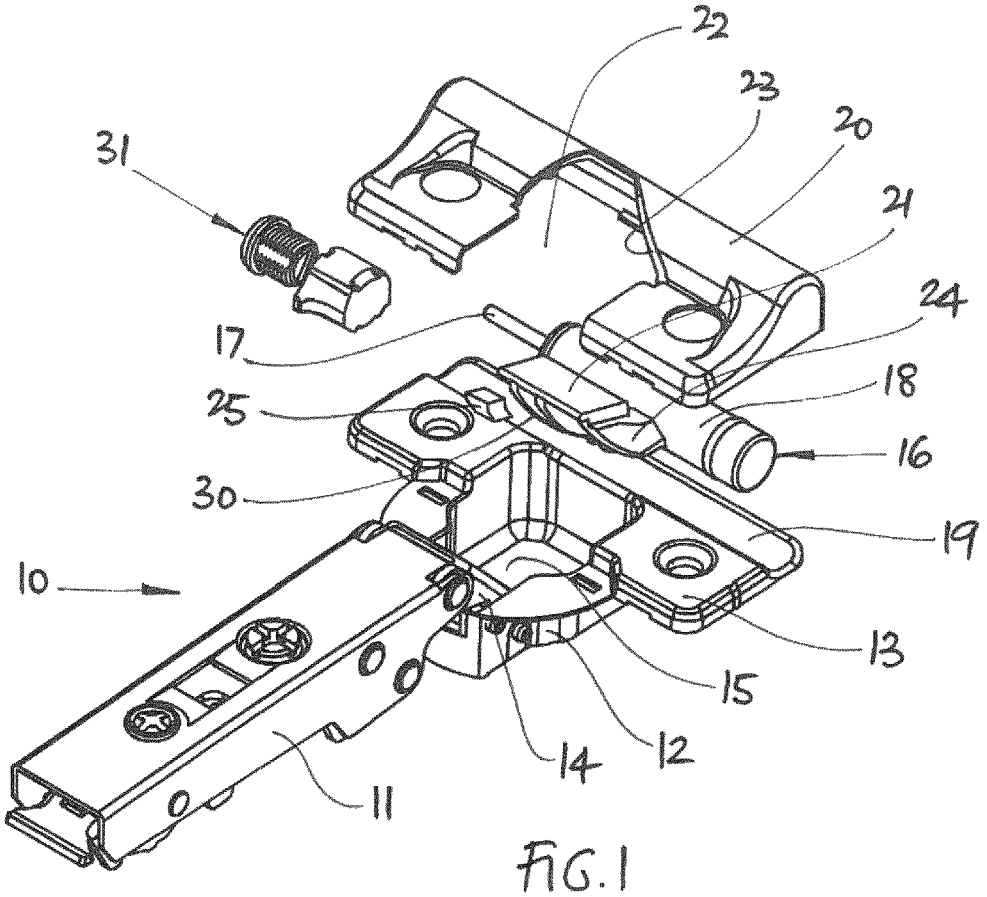
Figure 2:
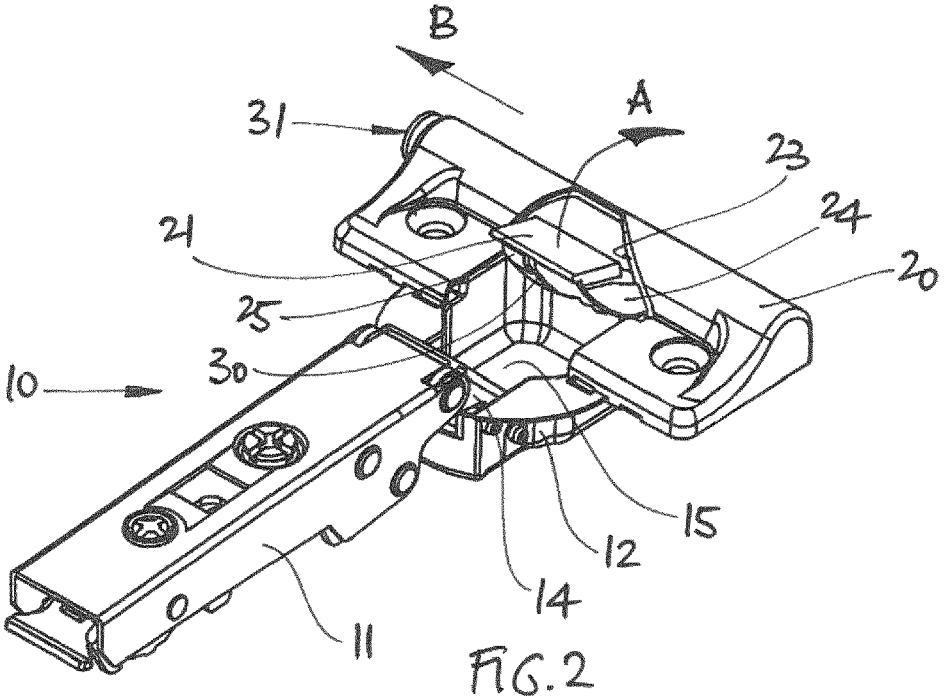
Figure 3:
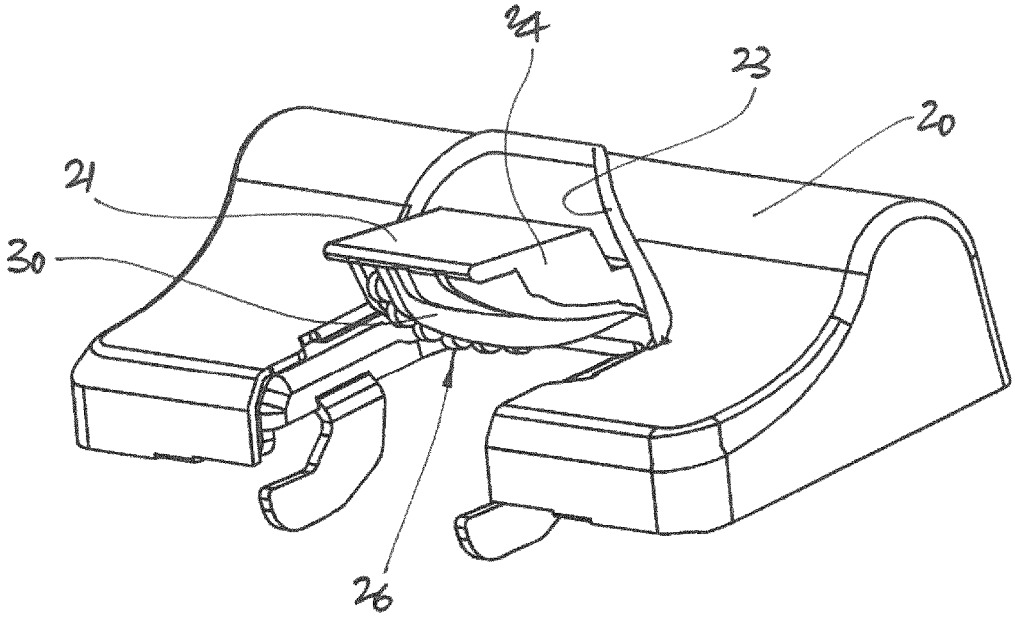
Figure 4:
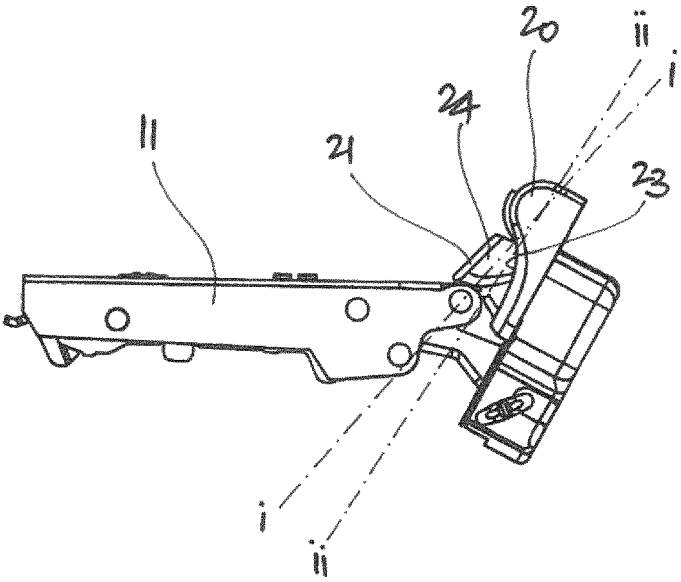
Figure 5:
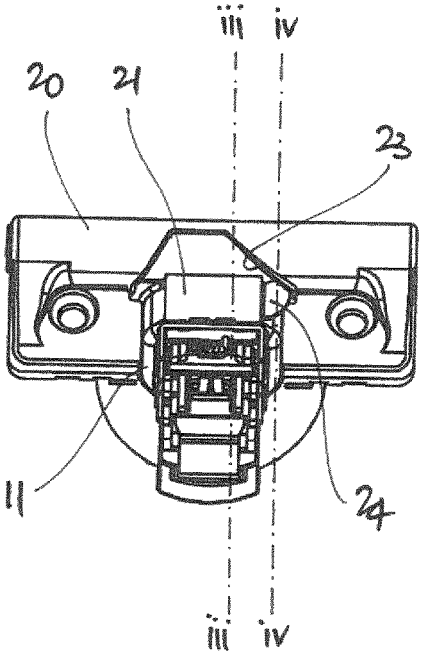

By way of example, embodiments of the invention will now be described with reference to the accompanying drawings in which:

FIG. 1 is an exploded view showing a toggle type hinge and the components of a form of damper assembly according to the invention, FIG. 2 shows the damper assembly of FIG. 1 in position on the hinge, FIG. 3 is a detail view showing a modified form of the damper assembly seen in FIG. 1, FIG. 4 is a side view of the hinge and damper assembly of FIG. 1, and FIG. 5 is a plan view of the hinge and damper assembly of FIG. 1.

A hinge 10 is seen in FIG. 1 which is essentially of the well known toggle-type construction for hanging a door, e.g. on a kitchen cupboard. The hinge 10 comprises an arm assembly 11, which is attachable to a door frame in known manner, and a hinge cup 12 having a mounting flange 13, which is attachable to a door in known manner. The hinge cup 12 is pivotably connected to the arm assembly 11 by means of a compound linkage 14 which, with the lower end of the arm assembly 11, is able to fold into the interior space 15 of the hinge cup 12 in the closed position of the hinge 10, in known manner.

Also seen in FIG. 1 is a damping device 16 for the hinge 10. Here the damping device 16 comprises a conventionally known form of linear piston and cylinder type damper having a piston (not seen) connected to a piston rod 17 for reciprocal movement in a damping medium contained within a cylinder 18, with an internal spring (not seen) normally biasing the piston rod towards its extended position. The device 16 is designed to produce a damped resistive force upon its compression and is arranged to be mounted on the hinge 10 so as to provide damped resistance to the closing movement of the hinge, at least over part of this movement, in known manner.

The damping device 16 may be one that is designed to produce a constant damping force over its working stroke. Alternatively, it may be designed to produce a damping force that varies, for example one that increases progressively over the working stroke.

The damping device 16 here is designed to be mounted directly onto the hinge mounting flange 13, with its longitudinal axis parallel to the pivotal axis of the hinge. For this purpose, the mounting flange 13 has an elongate radiused groove 19 on its upper surface. The groove 19 is shaped to receive the cylinder 18 of the damping device 16, helping to locate it and guide its movement. The cylinder 18 is retained in position on the mounting flange 13 by means of a housing 20, which is attached to the flange by suitable means such as spring clips. The arrangement is such as to allow both axial and rotational movement of the cylinder 18, as will be explained in more detail below.

The housing could alternatively be mounted indirectly onto the mounting flange of the hinge, that is, via an intermediate plate. In this case, the radiused groove would be provided on the intermediate plate.

An adjustable plug 31 is provided on the housing 20 at its point of abutment with the free end of the piston rod 17. Adjusting the plug 31 enables the position of the free end of the piston rod 17 to be varied. This can be used to vary the damping characteristics of the assembly.

Extending laterally out from the cylinder 18 is an actuating lever 21. The lever 21 is arranged to protrude through a cutaway section 22 in the mid-portion of the housing 20, as will be seen in FIG. 2, where it is designed to come into engagement with the arm assembly 11. A first camming mechanism causes the lever 21 to rotate in response to closing movement of the hinge (in the direction of arrow A in FIG. 2). This mechanism is in the form of a camming surface 30 on the lever 21 which is engagable by the arm assembly 11. The camming surface 30 is profiled so that the lever 21, and hence also the cylinder 18, will be caused to rotate as the lower end of the arm assembly 11 moves into its folded position in the hinge cup 12.

A second camming mechanism causes linear displacement of the lever 21 in response to closing movement of the hinge. This mechanism is in the form of a camming surface 23 on the housing 20 which is engagable by a side face 24 of the lever 21. The camming surface 23 is profiled to extend generally helically with respect to the longitudinal axis of the damping device 16. As will be seen from FIG. 2, this means that when the lever 21 is rotated in the direction of arrow A, the side face 24 will be caused to ride along the camming surface 24, thus causing lateral displacement of the lever 21 in the direction of arrow B. Movement of the lever 21 in this manner means that the cylinder 18 will be also caused to move in the direction of arrow B, ie towards the free end of the piston rod 17. With the free end of the piston rod 17 being held in position by the plug 31, the net effect of this movement is to cause compression of the damping device 16. The device 16 thus produces a damped resistive force, which is transmitted back to the closing movement of the hinge 10 via the lever 21 and the arm assembly 11.

The camming surface 30, which engages the arm assembly 11, and the side face 24, which engages the camming surface 23, are both conveniently formed as part of the lever 21. However, it will be understood that these elements could be formed separately on the cylinder 18.

It will be appreciated that the profile of the camming surface 23 can be chosen to give different effects. For example, it could be designed to produce a constant rate of linear displacement of the lever 21 per degree of its rotation, or the rate could be made to vary. The camming surface is able to be formed with a relatively low pitch, which is helpful, because it means that the mechanism will not suffer from unduly high frictional forces.

For production reasons, instead of forming the camming surface 23 directly on the housing 20, it may be preferable to form it as a separate component to be attached to the housing, for example in the form of an insert of plastics material.

It will also be appreciated that instead of locating the camming surface on the housing, it may be possible to locate it on the lever. In that case, the housing would have a suitable land to engage the camming surface to produce the desired camming effect.

It will be further appreciated that although the lever 21 is formed here as part of the cylinder 18 of the damping device 16, as an alternative, it would be possible to form it instead as part of a sleeve that encloses the damping device. In that case, the damping device can be a standard unit.

Hinges of the kind described above can expect on occasion to experience relatively high impact forces, for example from slamming doors. These can generate significant torsional forces on the hinge and damper assembly which, if they are excessive, can lead to distortion of components, with possible jamming of the piston or even total failure of the damping device. The design of the movement converting mechanisms described above help to minimise these problems.

The line of action of the engagement of lever 21 on the housing 20 is reasonably closely aligned with the line of action of the force transmitted to the lever by the arm assembly 11. This is seen in FIG. 4, where line i-i represents a plane passing through the longitudinal axis of the damping device and the point of initial engagement of the arm assembly 11 with the lever 21, and line ii-ii represents a plane passing through the longitudinal axis of the damping device and the initial point of engagement of the lever 21 with the camming surface 23 on the housing 20. Having these planes coincident or at least reasonably closely adjacent will help to reduce unwanted torsional forces being introduced into the system.

It also helps to reduce creation of unwanted torsional forces if the transmission of forces in a plane perpendicular to the longitudinal axis of the damping device are coincident or at least reasonably closely adjacent. This is seen in FIG. 5, where line iii-iii represents a plane perpendicular to the longitudinal axis of the damping device and passing through the initial point of engagement of the arm assembly 11 with the lever 21, and line iv-iv, which represents a plane perpendicular to the longitudinal axis of the damping device and the initial point of engagement of the side face 24 of the lever 21 with the camming surface 23 on the housing 20.

Another potential problem with hinge damper assemblies of the kind described above is noise of operation. There can typically be two components to this. A first one is noise from the initial impact of the arm assembly 11 as it comes into engagement with the lever 21. A solution for eliminating or at least reducing this noise is to introduce a shock-absorbing element at the point of engagement. In the arrangement seen in FIGS. 1 and 2, this is achieved by inserting a buffer 25 of a suitably resilient material such as rubber or the like into the lever 21. The buffer 25 helps to absorb the energy of the impact from the arm assembly 11 and hence minimise the generation of noise.

The other component of noise is that generated by the sliding frictional contact between the engaging surfaces of the arm assembly 11 and the lever 21. A solution to eliminating or at least reducing this noise is to mount a series of rotatable rollers 26 on the camming surface 30 of the lever 21, as seen in the modified form of FIG. 3. Now, instead of sliding frictional contact, the arm assembly 11 acts on the lever 21 with rolling contact.

The invention claimed is:

1. A damper assembly for a toggle type hinge with a mounting flange and hinge arm assembly pivotally connected thereto, the damper assembly comprising a damping device actuable along a linear axis, a housing mounted in use directly or indirectly on the mounting flange and retaining the damping device thereon with its linear axis parallel to the pivotal axis of the hinge, and means for converting pivotal movement of the hinge into linear actuation of the damping device over at least part of the range of pivotal movement of the hinge in one direction, wherein the movement converting means comprises an actuating lever connected to the damping device and engageable with the hinge arm assembly via a first camming mechanism, the movement converting means also comprising a second camming mechanism, wherein the first camming mechanism comprises a first camming surface on the actuating lever, whereby the hinge arm assembly engages with the first camming surface to cause the actuating lever to rotate in response to pivotal movement of the hinge arm assembly, and wherein the second camming mechanism comprises a second camming surface on the housing, whereby a side face of the actuating lever acts against the second camming surface to cause linear displacement of the actuating lever in response to its rotational movement.

2. A damper assembly as claimed in claim 1 wherein each of the camming mechanisms is in the form of a follower engaging a camming surface, with the point of engagement of each mechanism lying in a respective plane passing through the linear axis of the damping device, and with these planes being coincident or at least closely adjacent to each other, at least at the stage of initial engagement of the first camming mechanism.

3. A damper assembly as claimed in claim 1 wherein each of the camming mechanisms is in the form of a follower engaging a camming surface, with the point of engagement of each mechanism being in a respective plane lying perpendicular to the linear axis of the damping device, and with these planes being coincident or at least closely adjacent to each other, at least at the stage of initial engagement of the first camming mechanism.

4. A damper assembly as claimed in claim 1 wherein the second camming surface is formed separately from the housing and attached to it.

5. A damper assembly as claimed in claim 1 wherein the second camming surface on the housing extends generally helically and has a low pitch.

6. A damper assembly as claimed in claim 1 wherein the second camming surface on the housing has a pitch that varies along its extent.

7. A damper assembly as claimed in claim 1 wherein a shock-absorbing buffer is mounted on the actuating lever at its point of initial engagement with the hinge arm assembly.

8. A damper assembly as claimed in claim 1 wherein a series of rotatable rollers are provided on the actuating lever for its engagement with the hinge arm assembly.

9. A hinge incorporating a damper assembly as claimed in claim 1.

* * * * *